United States Patent [19]

Hesser et al.

[11] Patent Number: 4,726,468

[45] Date of Patent: Feb. 23, 1988

[54] STABILIZER BOX WITH VARIABLE OPENING

[75] Inventors: Paul R. Hesser, Kildeer; Bernard Zylstra, Elk Grove Village, both of Ill.

[73] Assignee: Chicago Corrugated Box Co., Elk Grove Village, Ill.

[21] Appl. No.: 908,936

[22] Filed: Sep. 15, 1986

Related U.S. Application Data

[63] Continuation of Ser. No. 710,027, Mar. 11, 1985, abandoned.

[51] Int. Cl.[4] ..... B65D 85/52

[52] U.S. Cl. ..... 206/423; 47/84; 206/485; 206/588; 206/592; 279/87 P; 279/138; 248/150; 248/152

[58] Field of Search ..... 229/37 R, 87 P, 39 B, 229/138; 206/418, 423, 446, 303, 454, 443, 485, 490, 491, 588, 592, 521; 47/84, 86, 41.11, 41.2; 248/27.8, 149, 150, 152, 146; 211/60.1, 72, 73

[56] References Cited

U.S. PATENT DOCUMENTS

| | | | |
|---|---|---|---|
| 1,587,038 | 6/1926 | Sandor | 229/37 R |
| 1,891,839 | 12/1932 | Robinson | 229/37 R |
| 1,954,006 | 4/1934 | Wolf | 206/423 X |
| 2,293,187 | 8/1942 | Becker | 206/485 X |
| 2,643,814 | 6/1953 | Bradley | 206/418 X |
| 2,798,656 | 7/1957 | Kuchenbecker | 206/633 X |
| 2,980,240 | 4/1961 | Amatel | 206/45.14 |
| 3,337,033 | 8/1967 | Cote | 229/39 B |
| 3,526,352 | 9/1970 | Swett | 229/138 X |
| 3,529,763 | 9/1970 | Wagner | 229/138 |

FOREIGN PATENT DOCUMENTS

| | | | |
|---|---|---|---|
| 1469650 | 2/1967 | France | 47/84 |
| 932669 | 7/1963 | United Kingdom | 206/521 |
| 2162497 | 2/1986 | United Kingdom | 206/423 |

*Primary Examiner*—Stephen Marcus
*Assistant Examiner*—Bryon Gehman
*Attorney, Agent, or Firm*—Laff, Whitesel, Conte & Saret

[57] ABSTRACT

A stabilizer box has a number of interconnected panels which automatically articulate to form a bottom which converts the box from a flat and knock-down shape into a cubical configuration. The box opens and the bottom locks in place simply by pushing on the opposite ends of the flat, knock-down shape. The top of the box is formed by four interconnected wedge or somewhat pie-shaped panels which snap down into the plane of the top of the cube responsive to a slight pressure of the thumb upon articulation panels. Each of the four wedge or somewhat pie-shaped top panels has a quarter circle, arcuate cutout, at the tip of the wedge or somewhat pie-shaped panels. The cutouts come together to form a variable circular opening when the top is set up. When the end of a generally cylindrical object, such as a bud vase, flower pot, bowl, or the like, is pushed down over that circular hole, the four top panels move downwardly and into the box so that the diameter of the circular opening becomes large enough for the end of the object to pass into the box. The downward motion causes a stress upon adjacent wedge or somewhat pie-shaped panels which pull them back into a bracing position, acting against the surface of the cylinder.

6 Claims, 9 Drawing Figures

STABILIZER BOX WITH VARIABLE OPENING

This is a continuation of U.S. patent application Ser. No. 710,027, filed Mar. 11, 1985, now abandoned.

This invention relates to containers and, more particularly, to stabilizer boxes with variable openings for giving shock resistant support to objects, usually cylindrical, having any of a great variety of different sizes.

The invention may find use whenever there is a need to provide a shock resistant support for objects, which may have a great variety of different size. For example a manufacturer of crystal dinnerware may wish to ship or deliver water glasses, juice glasses, sugar bowl and creamer, the outside diameters of which may vary between two and four inches. A hospital might wish to ship or deliver bottles of medicine, blood samples, or the like. A pharmaceutical house may wish to ship or deliver a variety of bottles, test tubes, etc. Further examples of when the invention may find use are limited only by one's imagination. Therefore, the attached claims are not to be necessarily construed as being limited to any given product.

On the other hand, a reference to a specific product is desirable by way of example and for convenience of description. Thus, the invention will be described in terms of a box for transporting a bud vase containing cut flowers. A florist may also use the box to ship or deliver flower pots, bowls, or the like, containing cut or growing flowers. The specific need is to stabilize the vase, pots or bowls in an upright position, even though they contain a plant which makes them top heavy.

A bud vase may have almost any shape (generally cylindrical) and may have almost any surface decoration thereon. For example, one vase may have a flaring bottom rising through a thin column to a scalloped top. Another vase may be a plain column of constant diameter, but with the roughness of a surface embossment, such as the form of a bear climbing the column, for example. This embossed surface is a free form and does not have a circular cross section. Each of these vases may have a different diameter in the area where it is held and supported by the inventive box. Hence, there are many totally different surfaces and diameters for the box to hold and support.

A second consideration is the manner in which the box is shipped or delivered to the end user and the ease with which it may be set up and used. More particularly, the box should be flat when shipped so that there is no bulk of empty air requiring either a shipping charge or storage space. When it is put into use, it should be set up with a single, simple hand motion. There should not be difficult and expensive labor, or any awkward motions when the box is put into use. When the vase is placed in the box, it should be possible to do so with no more than a simple push.

Accordingly, an object of the invention is to provide new and improved boxes for providing shock resistant support for generally cylindrical objects. Here, an object is to provide a single box which accommodates a wide range of different generally cylindrical sizes.

Another object is to provide boxes which receive and support a cylindrical object of almost any, and sometimes irregular, surface design.

Yet another object of the invention is to provide new and improved boxes of the described type which may be quickly set up by a simple push against diametrically opposed sides. In this connection, an object of the invention is to provide such a box which receives and supports a cylindrical object which is simply pushed into the box.

In keeping with an aspect of the invention, these and other objects of the invention are accomplished by a box having an automatic bottom of interconnected panels which converts it from a flat and collapsed shape into a locked cubical configuration. The bottom locks in place simply by pushing on the opposite ends of the flat and collapsed shape so that the interconnected panels automatically form themselves into the flat bottom as the opposite ends are pushed. The top of the box is formed by four interconnected wedge or somewhat pie-shaped panels which snap down to form a top of the cube responsive to a slight pressure of the thumb upon articulation panels. Each of the four top panels has a quarter circle cutout, the cutouts coming together to form a complete circular opening when the top is set up. When the end of a cylindrical object, such as a bud vase, is pushed down over that circular hole, the four top panels move downwardly and into the box so that the diameter of the circular opening becomes large enough for the end of the object to pass into the box. The downward motion causes a stress upon adjacent wedge or somewhat pie-shaped panels which pulls them back into a bracing position, acting against the surface of the cylinder.

A preferred embodiment is shown in the attached drawings in which.

Figure 1:
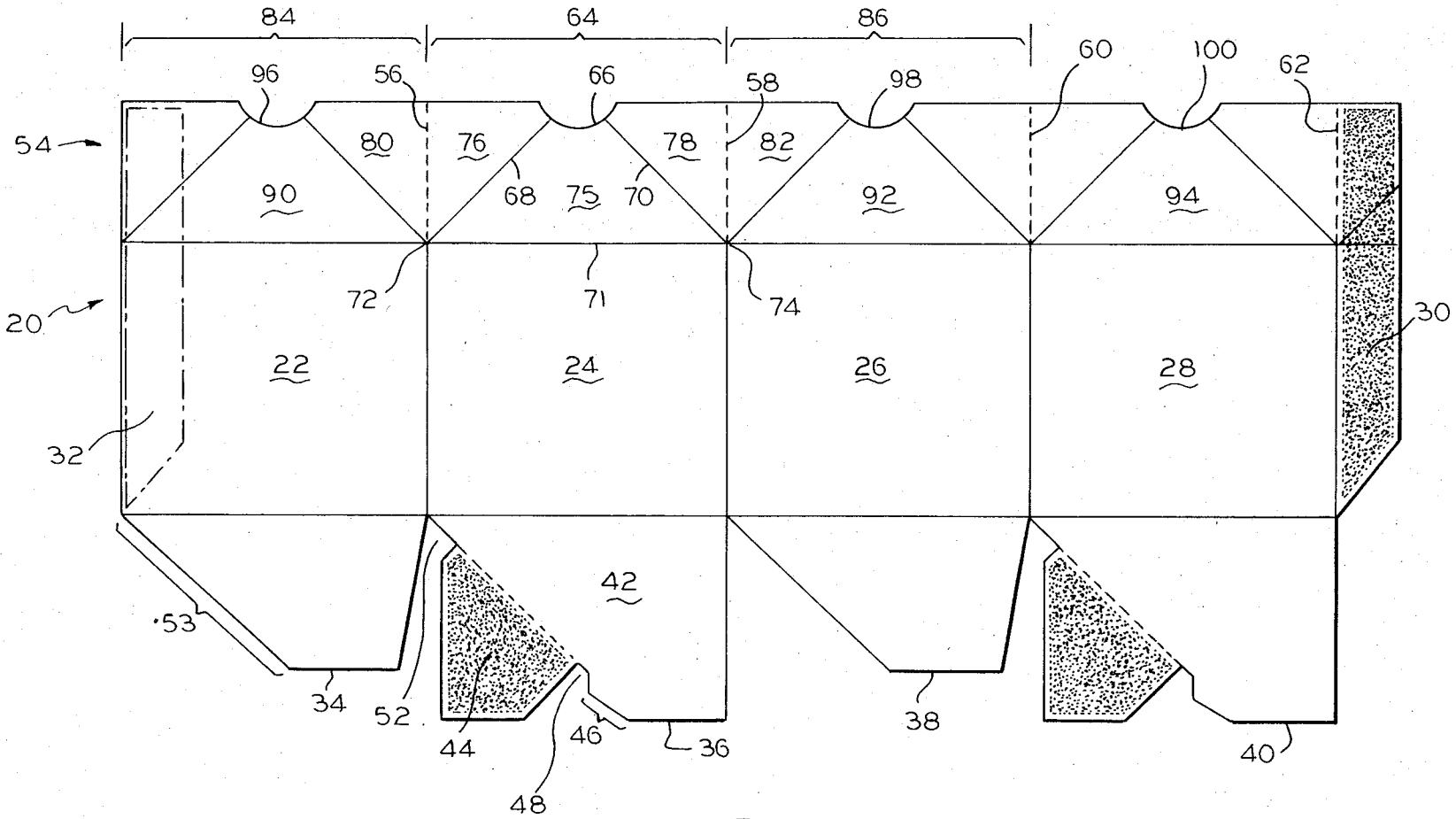
FIG. 1 is a corrugated cardboard blank which is used to make the inventive box.
Figure 2:
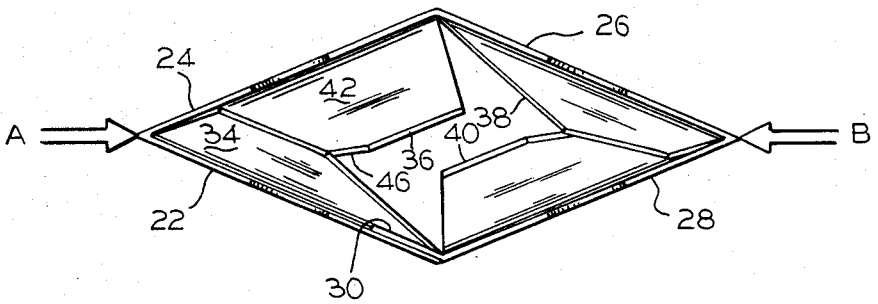
FIG. 2 is a plan view, looking down into the inside of the box, showing the action bottom at the start of the set-up operation.

The blank 20 of FIG. 1 includes score lines which are shown in the drawing by means of solid inked lines and semi-pierced lines which are shown in the drawing by means of dashed lines. A preferred blank is made from E-flute corrugated cardboard; however, that particular flute is not important. In fact, there is no inherent reason why corrugated cardboard must be used. Therefore, the following references to corrugated cardboard are to be read broadly enough to cover any suitable material.

The blank 20 is scored by four spaced parallel lines to form four side panels 22–28 and a glue flap 30. When the blank is folded along these score lines, and glue flap 30 is attached to the inside surface area 32 of panel 22, the four sides 22–28 form a cylinder with a square cross section.

Depending from the bottom of each of the side panels 22–28, is an automatic bottom closure flap 34, 36, 38, 40.

Of these, flaps 36, 40 have a glue half-flap panel and a bottom half-flap panel. For example, end flap 36 has a first half-panel 42 which ends up being the bottom of the box and a second half-flap panel 44 which is glued to the adjacent flap 34. Flaps 38, 40 are formed in a similar manner, with bottom flaps 38 and 40 adjacent and with the inside surface of half-flap panel 45 glued to the outer surface of panel 38. The bottom half-flap panel 42 has a guide edge 46 which helps move an adjacent flap panel 34 into position when the box is moved from the flat and collapsed shipping position to the erect position. A locking notch 48 is formed between the two half-flap panels 42, 44 to enable adjacent panel 34 to lock into place. A notch 52 is formed on each of the glue half-flap panels to eliminate bulk which could be an interference with the automatic operation of the box.

It should be noted that edge 53 of flap 34 is not connected to adjacent flap 40 and that flap 38 is not connected to flap 36. Thus, when folded between panels 24, 26 and between panels 22, 28, the cylinder lies flat. At this time, the bottom flaps are pushed up and into the box. When the box is opened to a cylinder, the interconnected flaps 34, 36 and 38, 40 pull each other to an open position which automatically become the bottom responsive to the opening of the box.

The top edges of the side panels 22–28 are integrally joined to a continuous strip 54 which provides four top panels for the automatic reception of many differently sized vases. In greater detail, above each of the side panels 34–40 has a corresponding top panel set off by a pair of semi-pierced lines 56–62. By way of example, panel 64 is defined by semi-pierced lines 56, 58 on the left and right, respectively. In the center of the top edge of panel 64 is an arcuate cutout 66. A pair of more or less diagonal score lines 68, 70 extend from the top corners 72, 74 of the side panel 24 to the arcuate cutout 66. The top panel central area 75 encompassed by the diagonal score lines 68, 70 is a wedge or somewhat pie-shaped segment equal to one-fourth of the surface at the top of the inventive box.

The diagonal score lines 68, 70 cooperate with the semi-pierced lines 56, 58 to form two articulating panels 76, 78 on opposite sides of the wedge or somewhat pie-shaped top panel central area 75. Each of these two articulating panels 76, 78 has an adjoining articulating panel 80, 82, respectively, on adjacent top panels 84, 86, respectively. When the top panel 64 (for example) folds along score lines 68, 70, 71, the articulating panels 80, 76 valley fold along semi-pierced line 56 and the articulating panels 78, 82 valley fold along semi-pierced line 58.

A similar folding occurs along the entire length of the continous strip 54. Therefore, each of the wedge or somewhat pie-shaped top panel central areas 90, 75, 92, 94 fold over and come together to cooperate with each other by forming a top surface. Each of the arcuate cutout areas 96, 66, 98, and 100 come together to form a circular opening. The adjacent edges (e.g. at score lines 68, 70) of top panel areas 90, 75, 92, 94 are floatingly supported by the valley folded articulating panels, such as 80, 76 and 78, 82.

If any or all of the wedge of somewhat pie-shaped top panel areas 90, 75, 92, 94 are pushed downwardly, they give, and the diameter of the circle formed by arcuate cutouts 96, 66, 98, 100 become larger. The valley folded articulating panels such as 80, 76 and 78, 82 tend to resist the push and to urge the pie-shaped top panel areas to move back in an upward direction. Thus, the diameter of the central hole automatically adjusts to the diameter of a bud vase that may be pushed through it.

The successive steps in the operation of the box is shown in FIGS. 2–9.

The end flaps 34–40 (FIG. 2) may be pushed up and inside the box, at which time the box lies flat for shipment with no waste space filled with dead air. When the opposite sides of the flattened box are pushed toward each other in the directions of arrows A, B, the end flaps 34–40 are pulled down, and the panels 34, 38 snap into lock notches, such as 48 (FIG. 1). The bottom of the erect box is now established and locked into position as the end flaps come into a single bottom plane which is perpendicular to the side panels. The inter-locking of flaps at notches 48 prevent the collapse of the box responsive to pressure on the sides of the box. If someone wants to intentionally collapse the box to return it to its flat or shipping condition, it is necessary to push upwardly on the interconnected panels forming the bottom of the box. The end flaps move into the box, and it is once again flat and in the shipping and storing condition.

Figure 3:
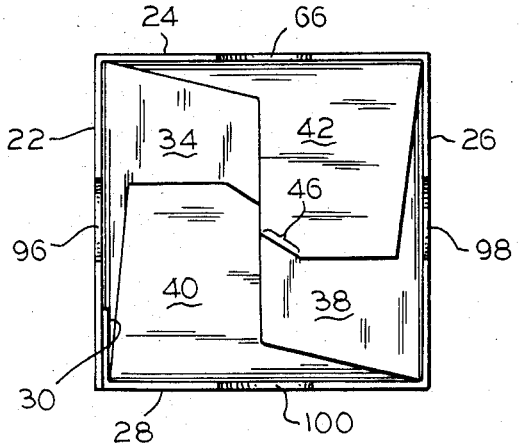
FIG. 3 is a plan view showing the inside of the bottom of the box in a set up condition.
Figure 4:
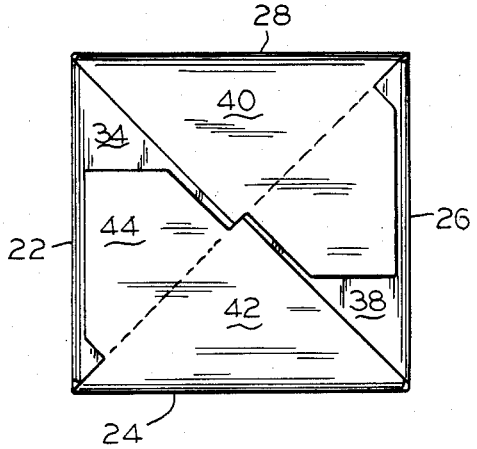
FIG. 4 is a plan view similar to FIG. 3, showing the outside of the box with the automatic bottom panels in a locked position.
Figure 5:
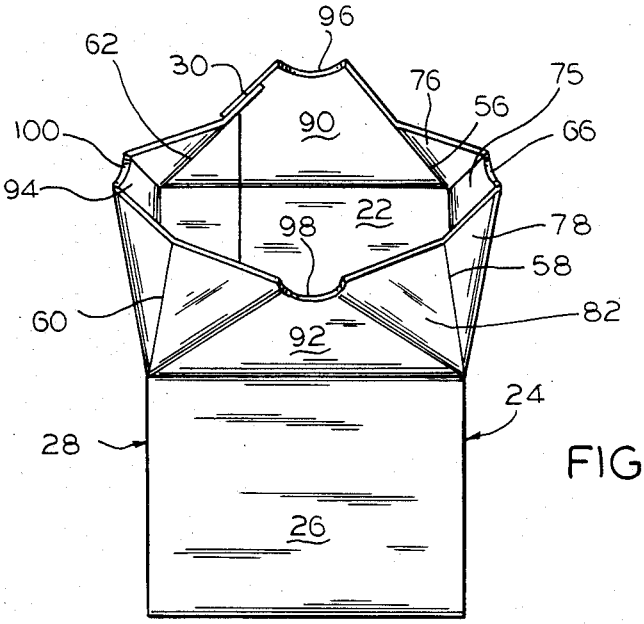
FIG. 5 is a perspective view which shows the box after the bottom is set up and before the top is pressed down into its final and usable state.

FIG. 3 shows the inside and FIG. 4 shows the outside of the bottom flaps when the box is in an opened condition. At this stage, the box has an appearance best seen in FIG. 5.

Figure 6:
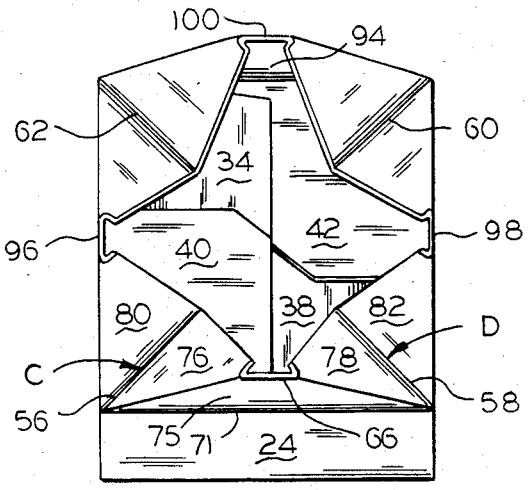
FIG. 6 is a perspective view of the box as shown in FIG. 5, which shows the start of the top folding of the box.

To close the top, a person places a thumb or finger on top of the semi-pierced lines 56, 58 and pushes as indicated by arrows C, D in FIG. 6. The articulating panels 80, 76 and 78, 82, valley fold into the box. A similar force is exerted on the semi-pierced lines 60, 62 to complete the folded top.

Figure 7:
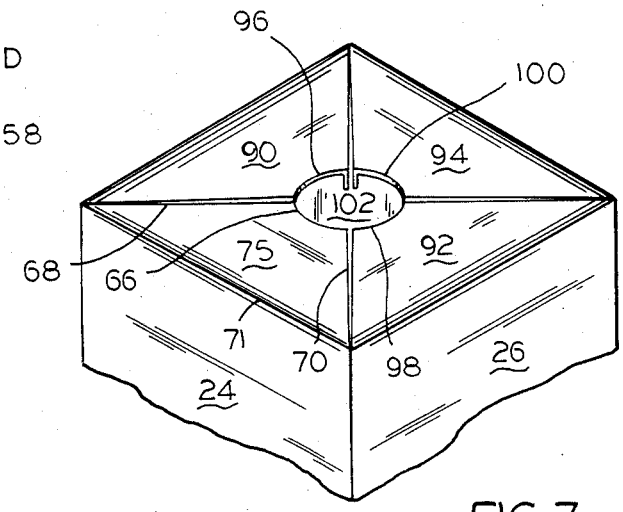
FIG. 7 is a perspective view of the top of the box which shows the top of the box in its final and usable form.
Figure 8:
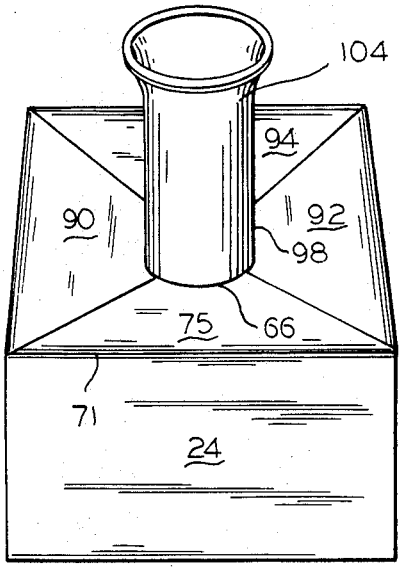
FIGS. 8 and 9 show the box with a small and a large vase, respectively, to illustrate how the top panels give in order to accommodate vases of different sizes.

The wedge or somewhat pie-shaped top panel central areas 75, 90, 92, 94 fold over and form a top surface (FIG. 7). The arcuate cutouts 66, 96, 98, 100 come together to form a circular hole 102.

If a small diameter vase 104 (FIG. 8) is placed over the circular hole 102 and pushed in a downward direction, the pie-shaped top panels give enough so that the diameter of the hole increases and the bottom of the vase may enter the box. As the vase comes to rest on the bottom of the box, the downward motion terminates. The valley folded articulation panels push the wedge or somewhat pie-shaped top panel central areas 75, 90, 92, 94 back in an upward direction, thereby bracing the vase.

Figure 9:
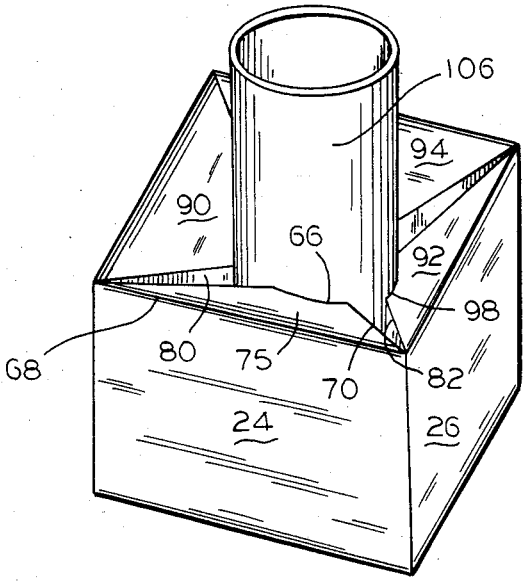

As shown in FIG. 9, the same effect occurs when a large vase 106 is placed in the box. However, the top panel central areas 75, 90, 92, 94 do not raise quite as much when they assume a vase bracing position.

Those who are skilled in the art will readily perceive how to modify the invention. Therefore, the appended claims are to be construed to cover all equivalent structures which fall within the true scope and spirit of the invention.

The claimed invention is:

1. A blank for forming a stabilizer box with a variable sized opening for giving shock resistant support to an enclosed container for floral products which may have any of many different sizes and configurations, said blank comprising a central portion having a plurality of spaced parallel score lines for defining a series of adjoining side panels, a plurality of end flaps dependent from said side panels for enabling said box to lie flat when collapsed or to hold said sides locked in an upright position when said box is erected, said end flaps having configurations which may be interconnected by bonding end flaps to each other, said interconnection of said end flaps enabling them to automatically articulate to form a flat bottom panel for supporting the weight of said container when setting in said box, a unitary strip of top panels attached to the top edges of said side panels, each of said top panels comprising a generally wedge-shaped central area equal to substantially one-quarter of the total area of the top of the box and an articulation panel which valley folds along its center line on opposite sides of said wedge-shaped areas to be under and support said wedge-shaped areas, said articulation panels extending centrally into said box for floatingly supporting said wedge-shaped top panel central areas in the top plane of the box, said articulation panels supporting said wedge-shaped areas in substantially a common plane when said box is empty, and an arcuate cutout on each of said top panels, said cutouts coming together to form a circular cutout opening when said wedge-shaped areas are folded into said top plane, said panels articulating to increase the diameter of said circular cutout opening when said floral container is simultaneously pushed against all wedge-shaped areas and through said panels to rest on said flat bottom panel, said articulation panels raising said centrally extending panels into said floating support position and thus placing said centrally extending panels in tension to stabilize said floral container in an upright position, the weight of said floral container acting on said flat bottom panel to immobilize said box.

2. The blank of claim 1 wherein each of said wedge-shaped top panel central areas is defined by a pair of diagonal lines extending from said arcuate cutout to opposing corners of said top panels.

3. The blank of claim 1 wherein articulating panels on adjacent ones of said top panels valley fold to provide said floating support.

4. The blank of claim 1 wherein each of said wedge-shaped top panel central areas is defined by a pair of diagonal lines extending from said arcuate cutout to adjacent corners of said top panels.

5. A combination comprising a support and stabilizer box with a floral container therein, said box having a variable top opening on a generally rectangular hollow box having a plurality of side panels, said box having a unitary top comprising a plurality of inwardly directed wedge-shaped top panels, each of said top panels being foldingly affixed to corresponding ones of said side panels, an arcuate cutout on the tip end of each of said wedge-shaped top panels, said cutouts being positioned to form a complete opening of variable diameter at the center of the top panel, means for floatingly supporting each of said top panels and urging it toward a position which establishes a minimum perimeter for said central opening, said means for floatingly supporting said wedge-shaped top panels comprises a valley folded pair of panels positioned between and attached to each wedge-shaped panel and its adjacent neighbor wedge-shaped panel, said valley fold being under and supporting said wedge-shaped top panels in substantially a common plane when said box is empty and placing them in tension when said floral container is in said box, said folding top panels giving way to increase said perimeter and admit said floral container when it is pressed against said opening and then moving back toward said minimum perimeter position to brace and support said floral container, and a bottom on said box for receiving the weight of said floral container for providing a stabilizing force against which said inwardly directed panels may be held to brace said floral container in said upright position.

6. A combination comprising a supporting and stabilizing box having a bottom and a top, a floral container, said top having a plurality of inwardly directed panels having cut out portions defining a center hole having a variable diameter, said inwardly directed panels being integrally joined by valley folds to provide an upwardly directed tension for holding said floral container in an upright position with said container projecting upwardly through said center hole in said top, said floral container having any of a great variety of sizes and shapes, said top comprising said plurality of inwardly directed panels having inner tip ends which together define said center hole in said top, said panels moving downwardly in response to a pressure applied by said floral container acting upon said panels whereby the size of said center hole becomes larger to admit said container, said valley folds urging said panels to return to their original positions which they occupied before said floral container exerted said pressure whereby said panels prop and stabilize said container in an upright position.

* * * * *